US007358456B1

(12) United States Patent
Julian et al.

(10) Patent No.: US 7,358,456 B1
(45) Date of Patent: Apr. 15, 2008

(54) SWIMMING POOL TOUCHPAD

(75) Inventors: Ryan T. Julian, Grand Rapids, MI (US); Richard A. Farnsworth, Grand Rapids, MI (US)

(73) Assignee: Industrial Service Technology, Inc., Grand Rapids, MI (US)

( * ) Notice: Subject to any disclaimer, the term of this patent is extended or adjusted under 35 U.S.C. 154(b) by 447 days.

(21) Appl. No.: 11/052,984

(22) Filed: Feb. 7, 2005

(51) Int. Cl.
*H01H 1/10* (2006.01)

(52) U.S. Cl. ..... 200/512; 200/517

(58) Field of Classification Search ..... 200/86 R, 200/85 A, 86.5, 512
See application file for complete search history.

(56) References Cited

U.S. PATENT DOCUMENTS 3,590,181 A * 6/1971 Baran ..... 200/52 R
3,732,556 A * 5/1973 Caprillo et al. ..... 340/566
3,745,275 A * 7/1973 Degiez ..... 200/52 R
3,784,768 A * 1/1974 Hunt ..... 200/52 R
3,916,214 A * 10/1975 Coble et al. ..... 307/119
3,920,940 A * 11/1975 Brown et al. ..... 200/52 R
3,944,763 A * 3/1976 Beierwaltes ..... 200/52 R
4,292,696 A * 10/1981 Berger ..... 4/505
4,475,016 A * 10/1984 Berger ..... 200/52 R
4,476,358 A * 10/1984 Capecchi ..... 200/52 R
4,700,369 A * 10/1987 Siegal et al. ..... 377/24.2
4,771,272 A * 9/1988 Barnes ..... 340/624
4,801,771 A * 1/1989 Mizuguchi et al. ..... 200/86 R
5,349,569 A * 9/1994 Tanaka ..... 368/10
5,675,942 A * 10/1997 Crawford ..... 52/127.3
5,702,799 A * 12/1997 Brown et al. ..... 428/143
5,942,966 A * 8/1999 Haake et al. ..... 337/4
5,977,493 A * 11/1999 Tanaka ..... 200/52 R
6,121,869 A * 9/2000 Burgess ..... 338/99
6,156,987 A * 12/2000 Warne ..... 200/512
6,584,678 B2 * 7/2003 Burgess et al. ..... 29/622

OTHER PUBLICATIONS

Daktronics, Inc., T-6000 Series touchpads, brochure or catalog, 1999, 2 pages, Daktronics, Inc., U.S.

* cited by examiner

*Primary Examiner*—Elvin Enad
*Assistant Examiner*—Lisa Klaus
(74) *Attorney, Agent, or Firm*—McGarry Bair PC

(57) ABSTRACT

A sealed two-plate swimming pool touchpad construction that is unaffected by pressure, in which a resilient, compressible, non-conductive spacer material such as rubber tubing is seated in an array of spaced recesses or grooves on the inside face of the rear plate to insulatively space a conductive, flexible front plate from the rear plate. The front plate is joined and sealed in watertight fashion to the rear plate around the array of grooves and spacer material. Conductive portions of the inside face of the front plate are flexed into switch-closing/signaling contact with conductive portions of the inside face of the rear plate between the spacer material when a swimmer makes contact with the front plate.

18 Claims, 7 Drawing Sheets

SWIMMING POOL TOUCHPAD

FIELD OF THE INVENTION

The present invention is in the field of swimming pool touchpads used by swimmers to record lap times.

BACKGROUND OF THE INVENTION

Electronic timing systems are commonly used for pool swimming races, with the recording of swimmers' start times, lap times (often referred to as split times), and finish times commonly being triggered by switches known as "touchpads". The touchpads are typically large, flat panels mounted underwater against the wall of the pool at the end of each swimming lane, positioned for a swimmer to make switch-closing contact with his hands or feet at the end of each lap. The touchpads are connected to a timing system that associates a start time, split time, or final time with each contact.

Switch sensitivity, speed, and dependability are critical given the precision expected of timing systems in modern swimming competition. Prior touchpads, however, often suffer from drawbacks in one or more of these categories. Typical touchpad construction is a sandwich of metal plates and internal switch contact surfaces in either an open, unsealed construction in which water flows freely over the switch contacts and other internal portions of the pad, or a sealed construction in which water is sealed out while the interior is pressurized to maintain proper switch sensitivity at varying pressures. As noted in U.S. Pat. No. 3,944,763 to Beierwaltes, unsealed touchpads are subject to corrosion, which leads to reduced switch sensitivity and even switch failure. Sealed, air-filled touchpads are sensitive to air and water pressure variations, and need frequent pressure adjustments to maintain proper spacing between the internal switch contact surfaces. While sealed touchpads are not subject to internal corrosion to the same extent as open-construction touchpads, they commonly use multiple layers of screen and foam that are not particularly sensitive or consistent and that are prone to compression set and degradation over time.

U.S. Pat. No. 6,156,987 to Warne discloses an open, unsealed, water-filled touchpad with three metal plates (thicker backplate, flexible thin faceplate, and flexible thin middle plate) spaced by non-conductive foam tape strips in staggered vertical rows, or in discontinuous horizontal rows, to define vertical drain passages for water when the touchpad is lifted from the water. The foam tape strips are said to be sufficiently resilient that a light touch on the faceplate either between or in line with the strips deflects the faceplate into the middle plate or the middle plate into the backplate, respectively. Upon release of the touch, the faceplate and middle plate return to their spaced-apart relationship. Brackets secured to the backplate around the edges of the touchpad are angled to overlie the faceplate edges to secure the vertical edge margins of the plates against movement outwardly and away from each other. To fight switch contact corrosion and plating problems in this unsealed touchpad, Warne uses heavy and expensive passivated stainless steel for the plates, and emphasizes the use of a very low DC voltage (around 0.25 volts) for the switch current through the plates. There appears to be no attempt to address the problems of foam inconsistency and degradation over time as noted by Beierwaltes, and since the foam tape strips are submerged in water they are believed to be even more prone to these problems than in sealed touchpad construction.

BRIEF SUMMARY OF THE INVENTION

The present invention is a sealed touchpad construction that does not require pressurization or adjustment to maintain constant switch contact spacing and sensitivity, and that has a simpler, more dependable internal switch structure than prior sealed or open touchpads. In its basic form the inventive touchpad is a two-plate conductive sandwich structure, with front and rear plates sealed around their perimeter, the plates spaced by a pattern of thin, non-conductive, compressible, resilient spacing material mounted in an array of grooves or recesses formed on an interior surface of the rear plate. Switch contacts are located on the opposing inner faces of the plates between the spacer material, in the simplest and preferred form being the conductive faces of the plates themselves. The spacer material maintains just enough distance between the opposing plates and their switch contact surfaces to allow them to be easily closed when a swimmer touches the outer front face of the touchpad, without being affected by pressure changes that would make them under- or over-sensitive across some or all of the touch surface. The sealed construction of the touchpad allows the use of inexpensive and lightweight metal plates, whose inner faces can form large switch contact surfaces without risk of corrosion or plating due to contact with pool water while carrying electrical current.

In a preferred form the spacing material is a compressible but resilient rubber type tubing. The tubing is resilient enough to be essentially uncompressed by pressure changes when the touchpad is submerged, and compressible enough to deform into the volume of the supporting grooves under a swimmer's touch.

In a further preferred form the spacing material is arranged in evenly-spaced horizontal lines defining uninterrupted horizontal switch contact panels across the width of the target area of the touchpad face, such that the touchpad face remains uniformly sensitive to contact and unaffected by vertical pressure variations up the face of the touchpad when submerged. The width of the switch contact panels between lines of spacing material is greater than the width of the spacing material. In a most preferred form, the spacing material and grooves are less than the thickness of a typical swimmer's finger.

The front plate of the touchpad, oriented toward the swimmer, is of thinner, more flexible construction than the rear plate, and the spacing material is seated in grooves formed in the thicker rear plate. Groove depth, the distance separating the lines of spacing material, the diameter or height of the spacing material, and the flexibility of the front plate determine switch sensitivity; all are easily controlled variables, and can be varied at different locations on the touchpad for different switch sensitivities, for example on the upper edge or lip of the pad.

Another feature of the invention is an internal perimeter connection that uses a structural-type adhesive foam tape to join and space the front and back plates. In a preferred form the internal perimeter connection provides a secondary internal seal, and is complemented by a primary external seal around the outer edges of the joined plates, achieved for example by coating the edges of the touchpad with a plastic material.

These and other features and advantages of the invention will become apparent upon further reading of the specification, in light of the accompanying drawings.

DETAILED DESCRIPTION OF THE INVENTION

Figure 1:
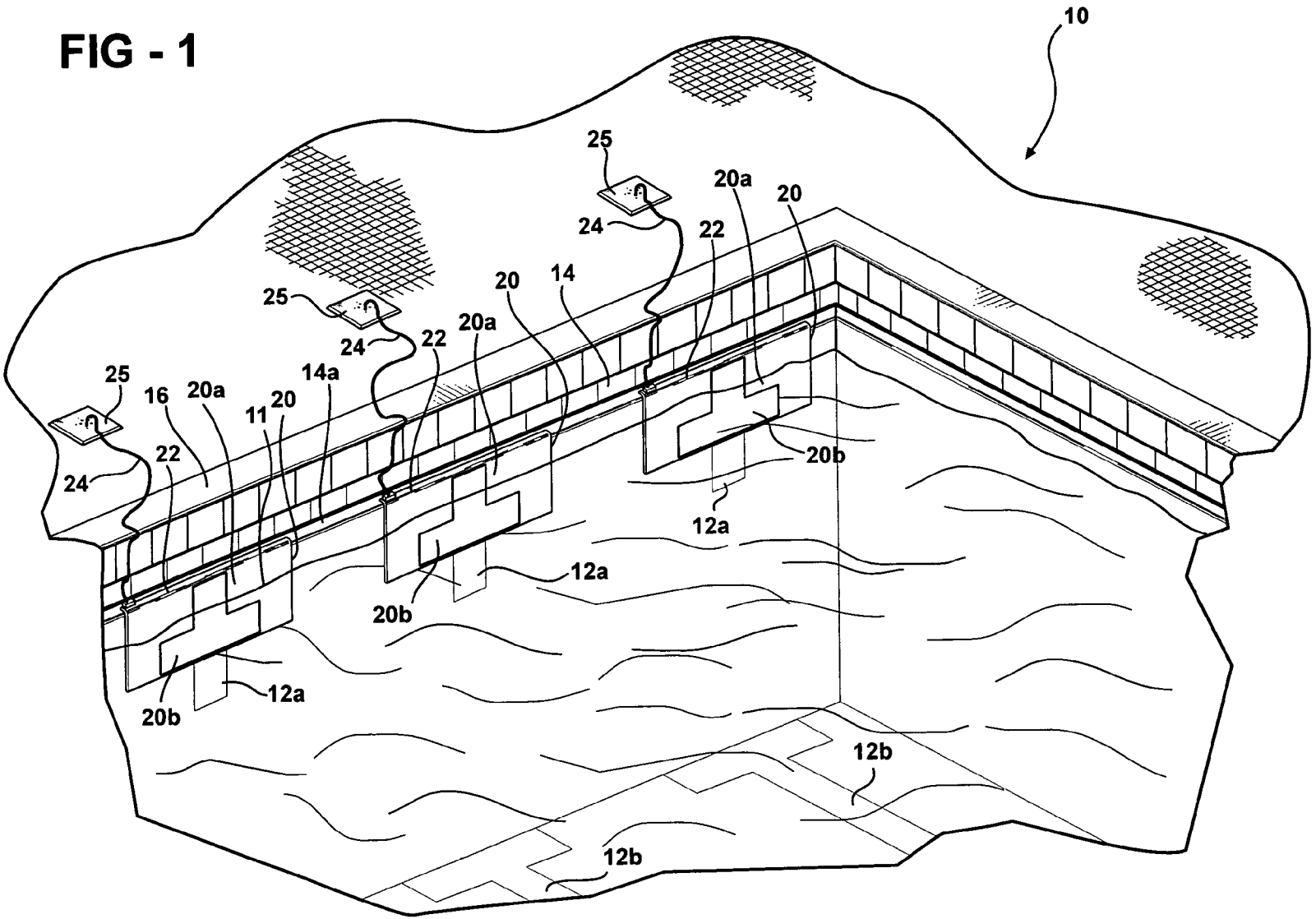
FIG. 1 is a perspective view of the end of a swimming pool divided into racing lanes, the end of each lane being provided with a touchpad according to the invention.

Referring first to FIG. 1, the invention is illustrated as touchpads 20 mounted on the end wall 14 of a swimming pool 10, aligned with lanes defined by painted lines or other standard markings 12*a*, 12*b*. Touchpads 20 are mounted in conventional fashion with an upper lip portion 22 supported on a pool end wall lip or gutter 14*a*; lip portion 22 can also be used to support the touchpad from pool deck 16, depending on the pool structure. Touchpads 20 can be used in portable fashion, set up and taken down for each race; or can be semi-permanently installed, for example by further securing the lip or other portions of the touchpad to the pool using bolts, brackets, adhesives, or other known techniques.

Each touchpad 20 is typically connected in known manner by cables or wires 24 to a timing system and low voltage DC current source, for example through permanent pool-deck mounted junctions or "deck plates" 25 associated with each lane, or through temporary serial cable connections. The touchpads 20 are essentially large switches, and a swimmer's contact with a front face 20*a* of the touchpad 20 (and optionally the upper surface of the lip portion 22) closes a circuit to send a signal to the timing system indicating the start or finish of a race or lap. Methods and structures for providing safe electrical current to the touchpad, and the various ways in which timing systems record swimmer hits on the touchpad, are generally known and their details are not necessary for an understanding of the present invention.

At least a portion of each touchpad 20 is submerged below water line 11, and typically most of the touchpad 20 will be underwater, with a smaller portion of the front face 20*a* and any lip portion 22 located above water to record misplaced hits, or hits for swimming strokes that are more convenient to make above the water. The front face 20*a* of the touchpad 20 is usually provided with a guide mark or pattern 20*b* that complements the markings in the pool, with the inverted T-shape shown believed to be standard.

Figure 2:
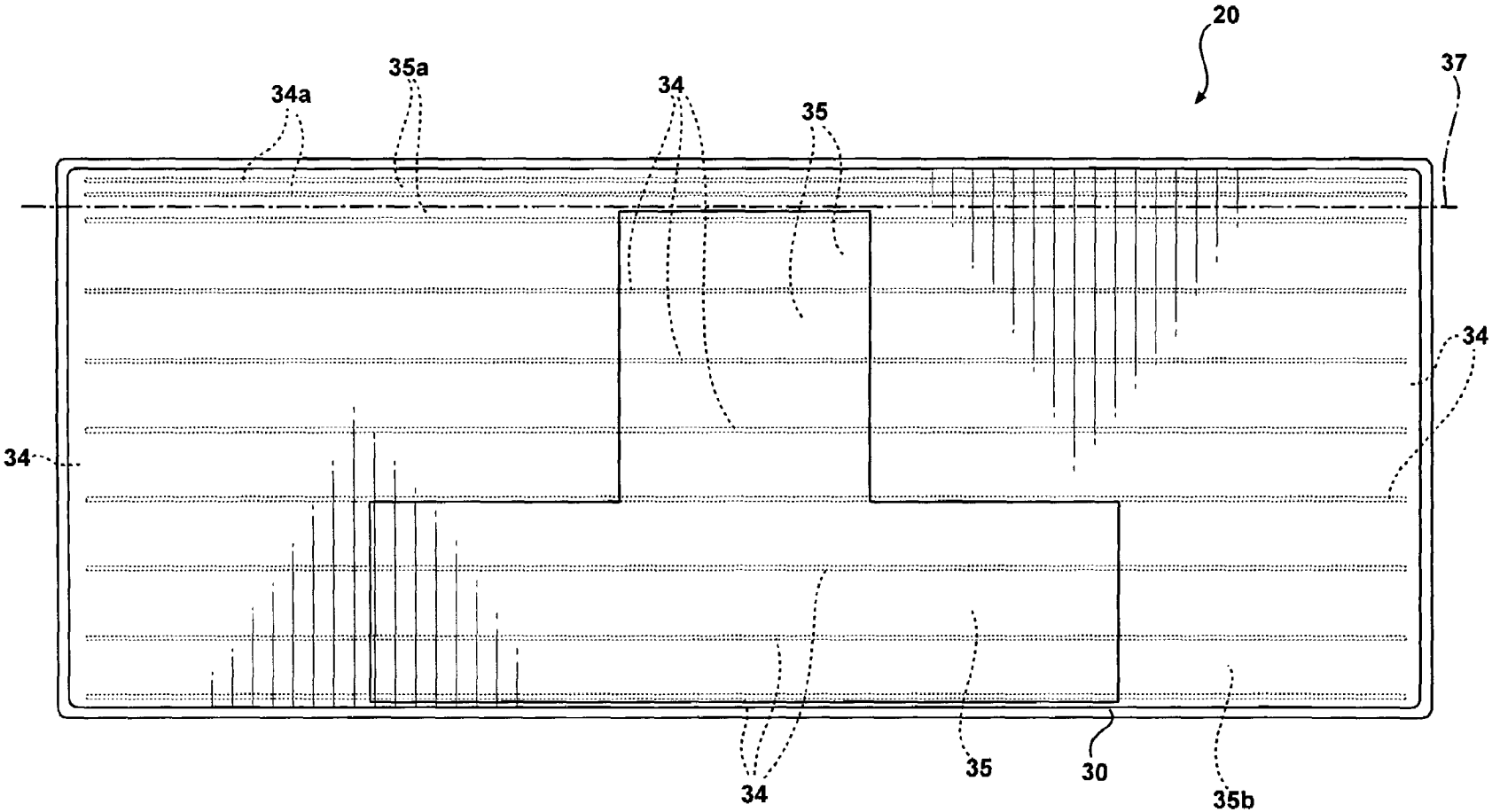
FIG. 2 is a front elevation view of one of the touchpads of FIG. 1 in a flat configuration, with internal components illustrated in hidden lines.
Figure 2A:
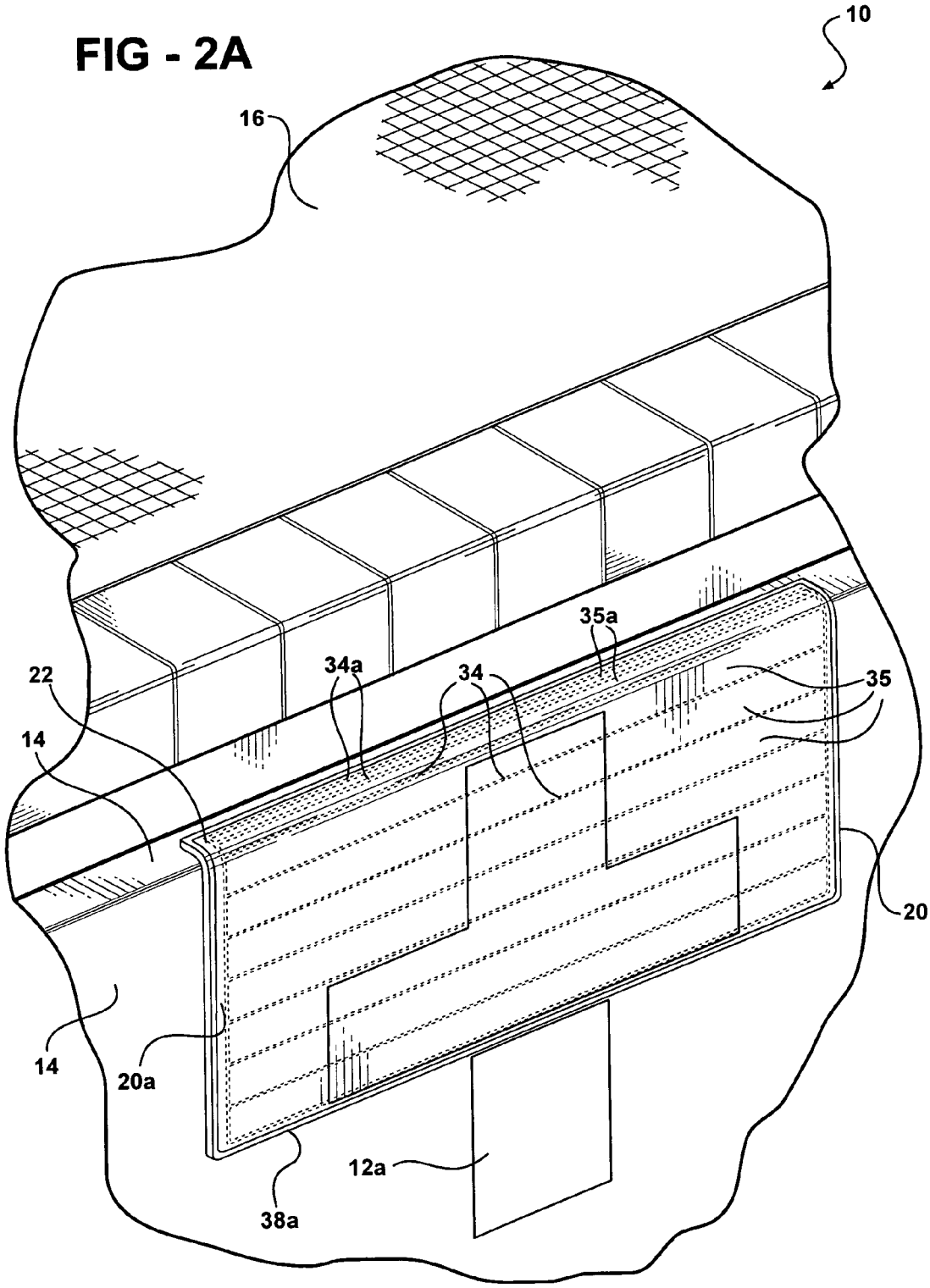
FIG. 2A illustrates the touchpad of FIG. 2 formed into the pool lip-engaging shape of FIG. 1.
Figure 3:
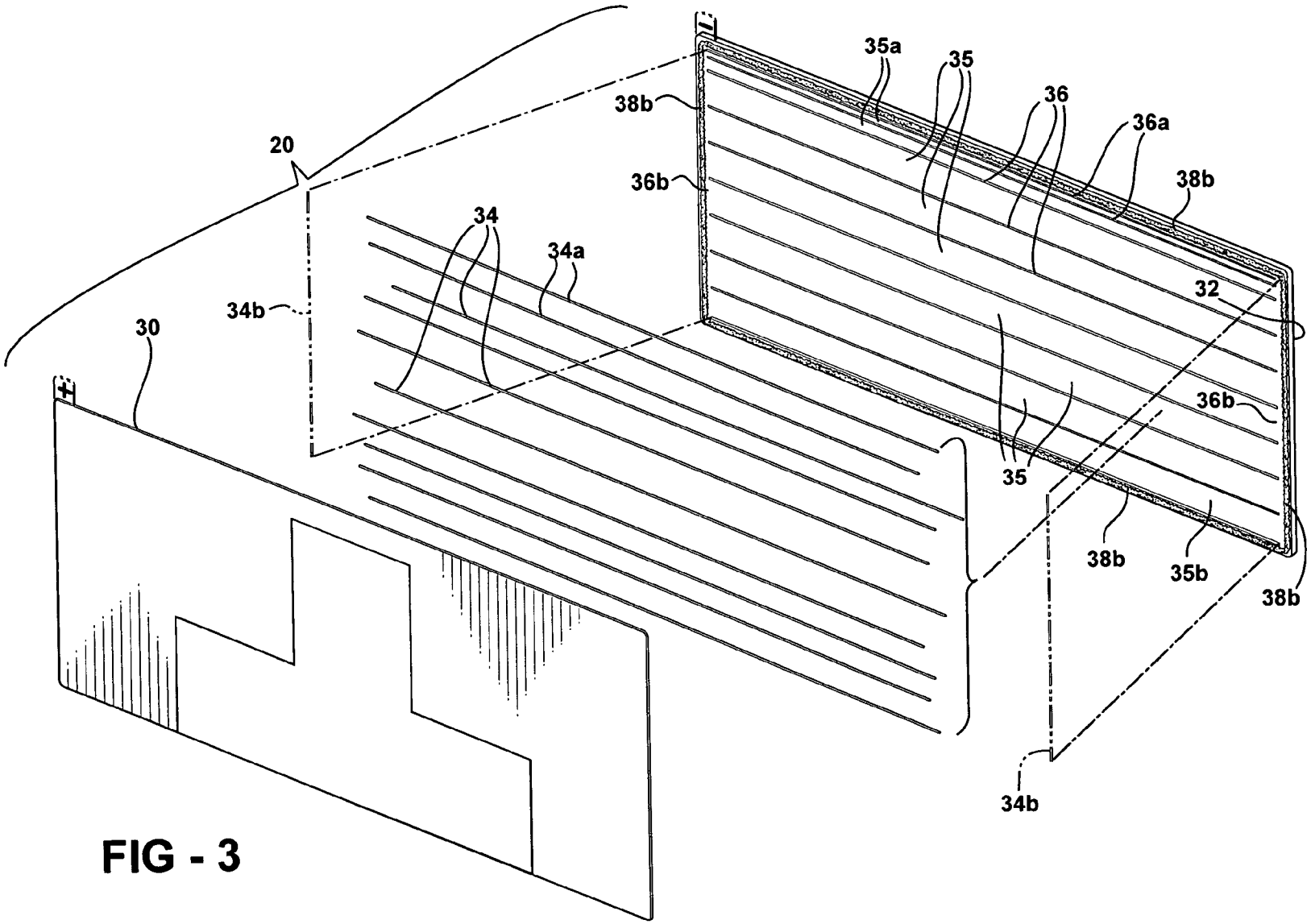
FIG. 3 is an exploded front perspective view of the touchpad of FIG. 2.
Figure 3A:
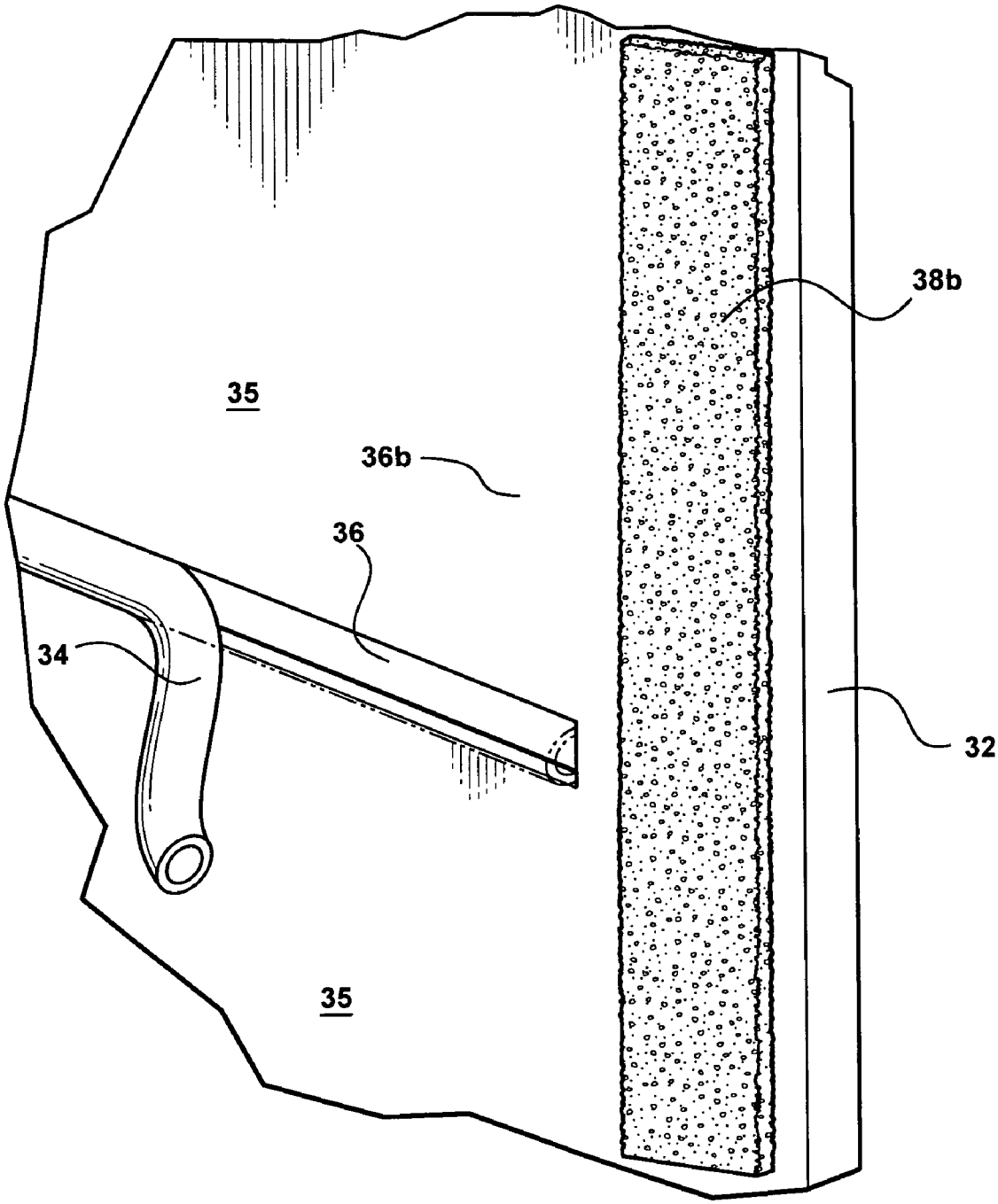
FIG. 3A is a detailed perspective view of a portion of the touchpad of FIG. 3.

Referring next to FIGS. 2, 2A and 3, touchpad 20 according to a preferred embodiment of the invention is a two-plate structure, with a conductive rear plate 32 and a conductive front plate or cover 30. In the illustrated embodiment the plates are made from aluminum using an alloy with the designation 5052. Although aluminum is the preferred material for front and rear plates 30, 32 due its electrical conductivity, corrosion-resistance, low cost, and low weight, it will be understood that other conductive metals can be used. It may even be possible to use conductive laminates or non-metal materials for one or both of the front and rear plates 30, 32, provided that the plate materials or at least portions of their inner surfaces or switch contacts applied to their inner surfaces when pressed together will conduct the low current voltage common to swimming pool touchpads in switch-closing fashion. It is also possible to make the front and rear plates 30, 32 out of different metals or materials, for example making the thicker rear plate 32 from an inexpensive, easy to mill, lightweight metal such as aluminum, and the thinner front plate 30 from a heavier metal or more exotic or expensive material.

Front and rear plates 30, 32 are provided with low voltage DC current in known manner as opposite poles of a switch, for example with rear plate 32 connected to negative 0.25 VDC and front plate 30 to positive. The switch contact surfaces of the front and rear plates 30, 32 must accordingly be kept apart and insulated until a swimmer intentionally contacts front plate 30. In the illustrated, preferred embodiment the front and rear plates 30, 32 are spaced by one or more spacers 34 secured in one or more grooves 36 in the face of the rear plate 32. As illustrated multiple spacers 34 are be arranged in a horizontal pattern across the rear plate 32 and can comprise a thin, non-conductive, compressible material. In the illustrated embodiment of FIGS. 2 and 3, each spacer 34 is a rubber gasket type material that is compressible enough to be deformable and shock-absorbent under swimmer contact forces, reducing stress on the connection between the spacer 34 and rear plate 32, yet is uncompressed and undeformed at normal swimming pool depth submerged pressures (usually less than five feet, although the effective pressure will vary at different altitudes). In the currently preferred form, each spacer 34 is a silicone rubber tubing with an outer diameter of 0.125 inches and an inner diameter of 0.075 inches. Hollow tubing is preferred to solid cord, which tends to deform more and develop a set shape over time, although suitably deformation-resistant cord could be used. Other rubber type materials or other resilient but compressible insulating materials could be used, but the rubber type tubing is highly preferred for its uniformity, and its ability to resist pool-depth pressures and permanent set or deformation while still compressing into the grooves 36 in the rear plate 32 under a swimmer's touch.

While touchpad 20 of FIGS. 2, 2A and 3 is shown in a flat configuration for ease of explanation, the upper portion of the touchpad 20 above phantom line 37 is intended to be bent or otherwise formed at a right angle to the rest of the touchpad 20, as shown in FIG. 2A, to form the lip portion 22. For this purpose the uppermost spacers 34*a* have a different spacing than the spacers 34 corresponding to the front face 20*a* of the touchpad 20, as explained in more detail below.

Figure 4:
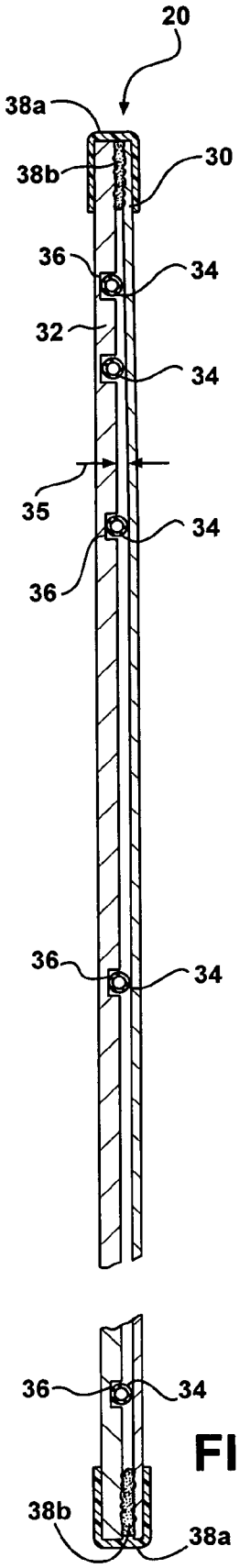
FIG. 4 is a side elevation view, in section, of the touchpad of FIG. 2.
Figure 4A:
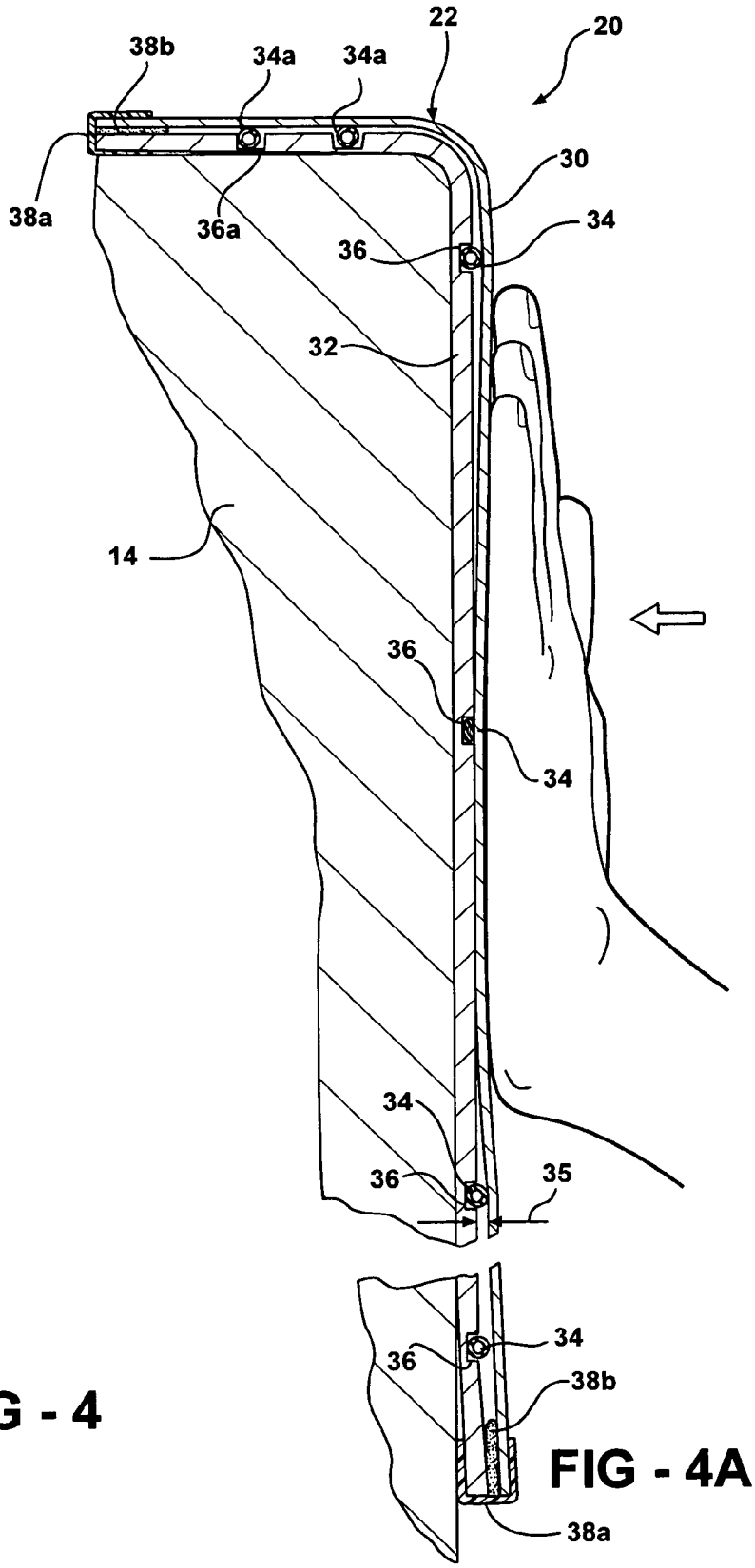
FIG. 4A is a section view similar to FIG. 4, but shows the touchpad in its final shape with an upper pool-engaging lip, and further shows the touchpad being contacted on its front face by a swimmer's hand.

As best shown in FIGS. 3, 3A, 4, and 4A, the spacers 34 are mounted on rear plate 32 in grooves or recesses 36 formed in the face of the rear plate 32, for example by milling, to a depth less than the diameter of the spacers 34, such that the spacers 34 are seated within the grooves 36 with a portion of the spacer 34 projecting beyond the face of the rear plate 32. The spacers 34 are preferably secured in grooves 36 with a non-conductive adhesive, for example a silicone caulk. In the illustrated embodiment, the depth of each groove 36 is approximately 0.05 inches, and the width of each groove for the 0.125 inch diameter rubber tubing that can be used as a spacer 34 is approximately 172 inches (1 1/64 inches). As best seen in FIGS. 4 and 4A, the grooves 36 are rectangular while the spacers 34 are round in cross-section. This is a preferred relationship between the tubing and grooves, similar to an O-ring, allowing deformation of the resilient tubing to be taken up by the corners of the rectangular grooves. It will be understood by those skilled in the art, however, that the relative size and geometry of the spacers 34 and grooves 36 can vary, and spacers 34 with seated portions matching the shape of grooves 36 may be an option.

It will be understood that the illustrated example of grooves 36 comprising long, thin, horizontal recesses with spacers 34 comprising thin continuous lines of material is preferred, but that other spacer patterns in which an insulating spacer material is seated in recessed portions of rear plate 32 are possible. For example, a vertical arrangement of grooves and spacers is possible. Or, the recesses for locating and mounting the spacer material could be formed as holes, dimples, or other non-linear or discontinuous shapes in linear or non-linear patterns on rear plate 32, with the spacer material formed and seated in the recesses accordingly. Or, as shown in phantom lines in FIG. 3, vertical spacers 34*b* could be added to corresponding vertical grooves (not shown in FIG. 3, but shown in FIG. 5) to complement the array of horizontal grooves 36 and spacers 34.

Front plate 30 is thin and flexible, while rear plate 32 has a thickness and stiffness sufficient to allow the formation of grooves 36 and to rigidly support the pattern of spacers 34 relative to front plate 30. In the illustrated embodiment, for example, front plate 30 has a thickness of approximately 0.032 inches, while rear plate 32 has a thickness of approximately 0.125 inches. The compressible nature of the spacers 34 is such that switch sensitivity is primarily a function of the spacing maintained between the front and rear plates 30, 32 by the spacers 34 and the compressibility of the spacers 34, and at most secondarily of the flexibility of the front plate 30. Accordingly, the sensitivity of the touchpad 20 can be primarily adjusted through the easily-controlled and consistent parameters of the depth and spacing of the grooves 36 formed in rear plate 32, and the thickness or diameter of the spacers 34 seated in the grooves 36.

Once the spacers 34 are securely mounted on rear plate 32, front plate 30 is secured to rear plate 32 with a resilient, insulated perimeter connection 38*b* around the perimeters of the inner faces of the front and rear plates 30, 32. In the illustrated embodiment, the perimeter connection 38*b* is made with a uniform border of strong adhesive foam tape to give both structure and insulating properties to the sealed connection between the front and rear plates 30, 32. Front plate 30 is spaced from rear plate 32 a distance corresponding to the height of the spacers 34 extending above the face of rear plate 32, which, in the illustrated embodiment, is on the order of 0.075 inches. The perimeter connection 38*b* preferably compresses when the front and rear plates 30, 32 are being sandwiched together until the front plate 30 encounters the spacers 34, and then cures or remains in place. The resilient nature of the spacers 34 can allow the front and rear plates 30, 32 to be secured together under some tension, if desired. In the illustrated embodiment, the perimeter connection 38*b* is a structural-type adhesive foam tape such as the "VHB" brand tape commercially available from 3M, and is on the order of 0.080 inches thick and 0.50 inches wide. While the foam tape type perimeter connection 38*b* as shown is preferred, it will be understood by those skilled in the art that other perimeter-connecting materials and methods can be used, so long as the perimeter connection 38*b* is strong and electrically insulating.

The perimeter connection 38*b* described above leaves the edge of the foam tape preferably used for the perimeter connection 38*b* exposed around the perimeter edge of the touchpad 20. While the perimeter connection 38*b* is therefore preferably waterproof, creating a watertight seal between the edges of the joined front and rear plates 30, 32 around the perimeter of the touchpad 20, it is preferred that this seal be a secondary seal, and that the primary watertight seal around the joined front and rear plates 30, 32 be an external, electrically-insulating outer seal 38*a*, such one made of a dipped or molded polymer, covering at least the joined side edges of the front and rear plates 30, 32, and preferably further overlapping the outer faces of the front and rear plates 30, 32 around their joined perimeter. By way of non-limiting example, outer seal 38*a* can be a dip-coated plastic such as Plasti-Dip, or can be a rim-molded polyurethane material of known type applied using known techniques. While the dipped or molded external plastic outer seal 38*a* is highly preferred as the primary watertight seal, it will be understood that other outer seal materials and methods could be used.

The pattern of spacers 34 is preferably evenly spaced over most or all of the area corresponding to the front face 20*a* of touchpad 20. For example, the illustrated embodiment represents a standard size touchpad 20, approximately five feet wide by two feet high, with each spacer 34 spaced approximately three inches apart, except at the top of the touchpad 20 where the uppermost spacers 34*a* are spaced closer together to form the pool-engaging lip portion 22, and at the bottom of the touchpad 20 where the lowermost two spaacers 34 are slightly closer together (for example, a half-inch) to define a narrower contact panel 35*b* to adjust for the slightly greater water pressure at the lower end of the touchpad 20 when submerged. Although the spacing of the uppermost spacers 34*a* in lip portion 22 is narrower, contact sensitivity similar to that across the front face 20*a* as a whole is achieved by milling grooves 36*a* associated with the lip portion 22 to a greater depth than grooves 36 associated with the front face 20*a*.

As shown in FIG. 4A, when a swimmer's hand hits the touchpad 20, the adjacent interior conductive surface of front plate 30 is flexed into switch-closing contact with a corresponding switch contact surface 35 on rear plate 32 between spacers 34, transmitting an electrical "hit" signal to the timing system. The spacers 34 adjacent the hit will be compressed into its/their supporting groove(s) 36 to absorb shock and to allow the front plate 30 to contact the rear plate 32, even immediately adjacent the edges of grooves 36. If the grooves 36 and/or spacers 34 have a thickness less than a typical finger, even a finger-width contact directly over a spacer 34 will allow the front and rear plates 30, 32 to make electrical contact on either side of the groove 36. When the swimmer's hand is removed, front plate 30 rebounds to its spaced, switch-open position of FIG. 4.

Figure 5:
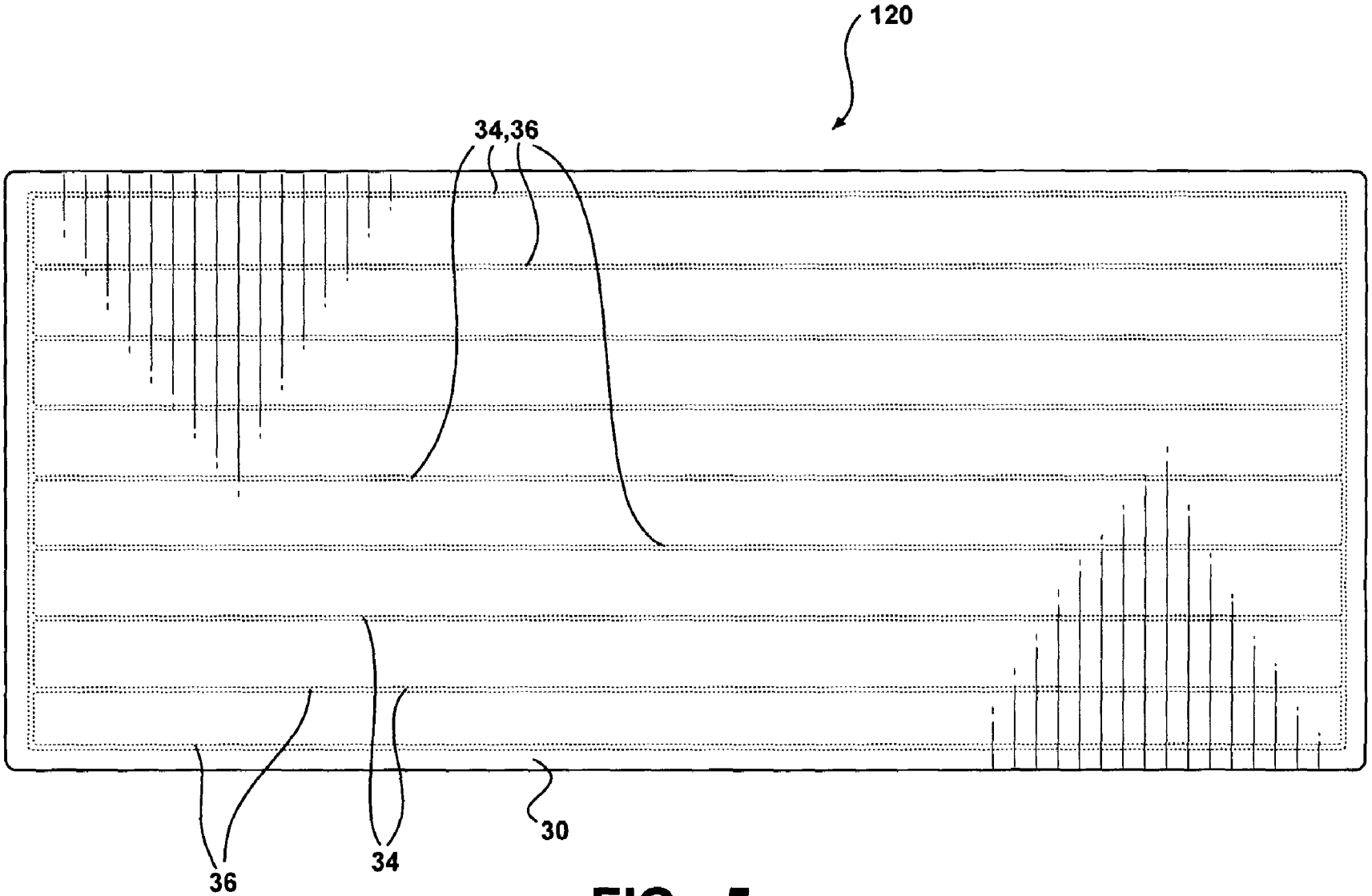
FIG. 5 is similar to FIG. 2, but shows an alternate arrangement for the internal plate-spacing material in which the touchpad is without an upper pool-engaging lip.

FIG. 5 is an alternate embodiment of a touchpad 120 according to the invention, in which the touchpad 120 is intended to be employed as a flat panel without an upper lip. Touchpad 120 accordingly maintains an essentially even vertical spacing of spacers 34 and grooves 36 from top to bottom.

It will be understood from the foregoing example of one or more preferred embodiments of the invention that various changes can be made without departing from the scope of the invention as defined by the following claims. It will also be understood that while the illustrated touchpad construction is designed to operate as a swimming pool race signaling device, it may be put to other uses without departing from the invention.

We claim:

1. A sealed swimming pool touchpad construction comprising:

a rear plate;

an array of spaced recesses formed on an inside face of the rear plate;

a spacer seated in the recesses on the inside face of the rear plate, the spacer projecting above the inside face of the rear plate; and a flexible front plate secured to the rear plate and sealed in watertight fashion to the rear plate around the array of spaced recesses, the front plate being spaced from the rear plate by the spacer in the recesses, such that opposing electrically-conductive portions of an inside face of the front plate and the inside face of the rear plate between the recesses define spaced switch contact surfaces capable of being brought into switch-closing contact by a swimmer making contact with the front plate.

2. The swimming pool touchpad of claim 1, wherein the array of recesses comprises an array of spaced grooves.

3. The swimming pool touchpad of claim 2, wherein the spacer comprises a rubber type tubing material.

4. The swimming pool touchpad of claim 2, wherein the grooves are arranged horizontally across the rear plate to define a plurality of horizontal, vertically-spaced switch contact surfaces between the grooves on the rear plate.

5. The swimming pool touchpad of claim 4, wherein the vertical spacing of the grooves varies.

6. The swimming pool touchpad of claim 4, wherein the depth of the grooves varies.

7. The swimming pool touchpad of claim 4, wherein the grooves comprise continuous lines across the face of the touchpad.

8. The swimming pool touchpad of claim 7, wherein the spacer in the grooves is continuous.

9. The swimming pool touchpad of claim 1, wherein the spacing of the recesses in the array varies.

10. The swimming pool touchpad of claim 1, wherein the depth of the recesses varies.

11. The swimming pool touchpad of claim 1, wherein the front and rear plates are secured to one another with an interior perimeter connection.

12. The swimming pool touchpad of claim 11, wherein the interior perimeter connection comprises a structural foam tape.

13. The swimming pool touchpad of claim 11, wherein the front and rear plates are sealed in watertight fashion with an exterior perimeter seal over the interior perimeter connection.

14. The swimming pool touchpad of claim 13, wherein the exterior perimeter seal comprises a polymer coating.

15. The swimming pool touchpad of claim 1, wherein the front and rear plates comprise electrically conductive metal, and the switch contact surfaces comprise the interior faces of the front and rear plates.

16. The swimming pool touchpad of claim 15, wherein at least the rear plate comprises aluminum.

17. The swimming pool touchpad of claim 1, wherein the spacer is resilient, compressible, and electrically-insulating.

18. The swimming pool touchpad of claim 1, wherein the spacer comprises a plurality of spacers, each seated in a single recess.

* * * * *